United States Patent [19]

Steiger

[11] 4,148,288

[45] Apr. 10, 1979

[54] APPARATUS FOR OPERATING A RECIPROCATING INTERNAL COMBUSTION ENGINE

[75] Inventor: Anton Steiger, Illnau, Switzerland

[73] Assignee: Sulzer Brothers Limited, Winterthur, Switzerland

[21] Appl. No.: 715,150

[22] Filed: Aug. 17, 1976

[30] Foreign Application Priority Data

Jun. 11, 1976 [CH] Switzerland ..... 7391/76

[51] Int. Cl.[2] ..... F02M 39/00; F02M 39/02

[52] U.S. Cl. ..... 123/139 R; 123/32 JV; 123/32 AH; 123/122 E; 123/32 J

[58] Field of Search ..... 123/23, 32 J, 32 JV, 123/32 AH, 122 E, 139 R

[56] References Cited

U.S. PATENT DOCUMENTS

| | | | |
|---|---|---|---|
| 2,821,843 | 2/1958 | Mengelkamp et al. | 123/122 E |
| 2,831,468 | 4/1958 | Witzky | 123/32 JV |
| 2,897,800 | 8/1959 | Haas | 123/32 JV |
| 3,762,378 | 11/1971 | Bitonti | 123/122 E |

*Primary Examiner*—Samuel W. Engle
*Assistant Examiner*—Thomas H. Webb
*Attorney, Agent, or Firm*—Kenyon & Kenyon, Reilly, Carr & Chapin

[57] ABSTRACT

Liquified coal fuel is maintained in a liquified state by surrounding the injection pump, injection nozzle, suction line, pressure line and overflow line with jackets through which a heating medium is passed. The jackets surrounding the suction line, overflow line and pressure line are corrugated for expansion and are connected via bellows-like sealing bodies and flanges to the jacket surrounding the pump housing. Outlets are provided for leakage and are connected to separators to remove the fuel from the heating medium.

22 Claims, 5 Drawing Figures

25
29
34
28
159
33
31
32
35
33'
27
150
160
21
26
19
20
30
151
48
36
16
17
49
37
39
38
15
14
II
40
46
47
39'
18
51
13
52
11
10
8
5
7
63
65
61
12
9
4
53
55
6
55
60
50
57'
59
58
54
64
56
57
62
43
43'
37
44'
37'
44"
41
45
44
42
45
2
3
1
91
90
80
152
70
89
III
II
87
86
88
71
85'
77
85
81
153
73
72

79
74
76
78
154
75
II

Fig. 3
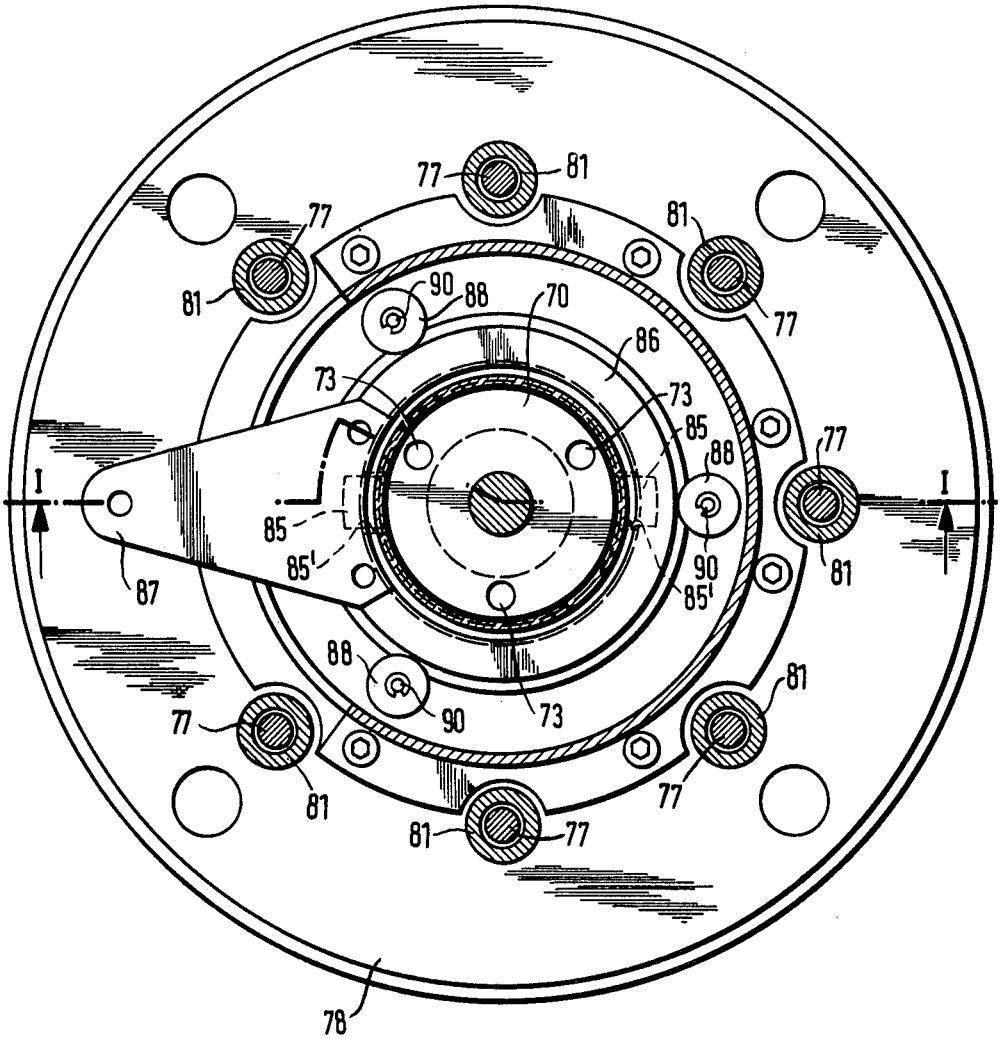
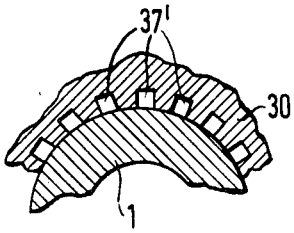
Fig. 4

25
29
117
116'
116
112
114
138
119
139
120
137
118
115
135
111
136
130
134
106
113
110
108
107
109
129
127'
100
121
105'
101
99
102
149
103
133
101'
128
132
127
131
105
102'
122
123
124
126
125

APPARATUS FOR OPERATING A RECIPROCATING INTERNAL COMBUSTION ENGINE

This invention relates to an apparatus for operating a reciprocating internal combustion engine.

As is known, attempts have been made to operate a reciprocating internal combustion engine with fuels other than oil, for example by using a liquified fuel, such as coal, which is normally solid under ambient conditions. However, if such a fuel solidifies for any reason while being used as a fuel, the fuel supply to the engine may well become blocked.

Accordingly, it is an object of the invention to ensure that a liquified fuel delivered to an internal combustion engine remains in a liquified state until delivery.

It is another object of the invention to supply a liquified coal fuel to an internal combustion engine in an economical trouble-free manner.

It is another object of the invention to provide a simple structure for supplying liquified coal to an internal combustion engine.

Briefly, the invention provides a means of heating a flow of liquified fuel during delivery to an internal combustion engine so as to maintain the fuel in a liquified state. To this end, the invention provides a combination of a cylinder head of a reciprocating internal combustion engine, an injection nozzle mounted in the cylinder head and an injection pump having a housing and a suction valve within the housing with a fuel heating means. In addition, where a suction line is connected to the pump housing in communication with the suction valve to deliver a flow of liquified fuel and a pressure line is connected between the pump housing and injection nozzle to deliver a pressurized flow of the fuel to the nozzle, the heating means also heats the suction line and pressure line to maintain the fuel in a liquified state.

The fuel primarily considered herein is the so-called "solvent-refined coal", i.e. coal which is freed of undesired impurities, particularly ash and sulfur, by means of solvents and is then resolidified. Such coal is liquified for the operation of internal-combustion engines by a method which is described in Swiss Patent Application No. 7390/76 filed June 11, 1976 and is fed to the internal-combustion engine in that form. The liquified fuel has a very high temperature, for instance, 400° C.

This construction ensures that the liquified fuel, which has a high temperature, retains its temperature during travel from the source, i.e. the point where the fuel is liquified, to the combustion chamber in the cylinder. Thus, the fuel is prevented from solidifying during travel and avoids those problems which could lead to trouble in operation.

In addition, the invention allows the running clearances of the pump piston, the suction and pressure valve as well as of the injection needle to remain approximately the same regardless of the absolute temperature of the liquified fuel.

According to one advantageous embodiment of the invention with a pump having a fuel overflow line, the means for heating the fuel includes jackets each of which concentrically surrounds the suction line, the pressure line, the overflow line, the injection pump and the injection nozzle and through which a heating medium flows. As a result, practically no temperature gradients occur in the parts situated within the jacket of the injection pump during operation. The heating medium which is used may well be a synthetic high-temperature-resistant oil and may be the same medium which was used as the heating medium in the liquifaction of the fuel.

According to a further advantageous embodiment of the invention, the space formed between the pump housing and the surrounding jacket is connected via a bore to an annular chamber which is provided between the pump piston and a cylinder guiding the piston while a second bore communicates the annular chamber with an outlet in the pump housing. This allows the use of a part of the heating medium as a flushing medium for the pump piston. As a result, fuel is prevented from escaping between the piston and the cylinder and then solidifying at relatively cold parts of the pump.

These and other objects and advantages of the invention will become more apparent from the following detailed description and appended claims taken in conjunction with the accompanying drawings in which:

FIG. 3 illustrates a view taken on line III—III of FIG. 1;

FIG. 4 illustrates a detail of the injection pump of FIG. 1 on a larger scale.

The apparatus for operating a reciprocating internal combustion engine includes, inter alia, an injection pump (FIG. 1) and an injection nozzle (FIG. 5) which are connected to each other via a pressure line.

Figure 1:
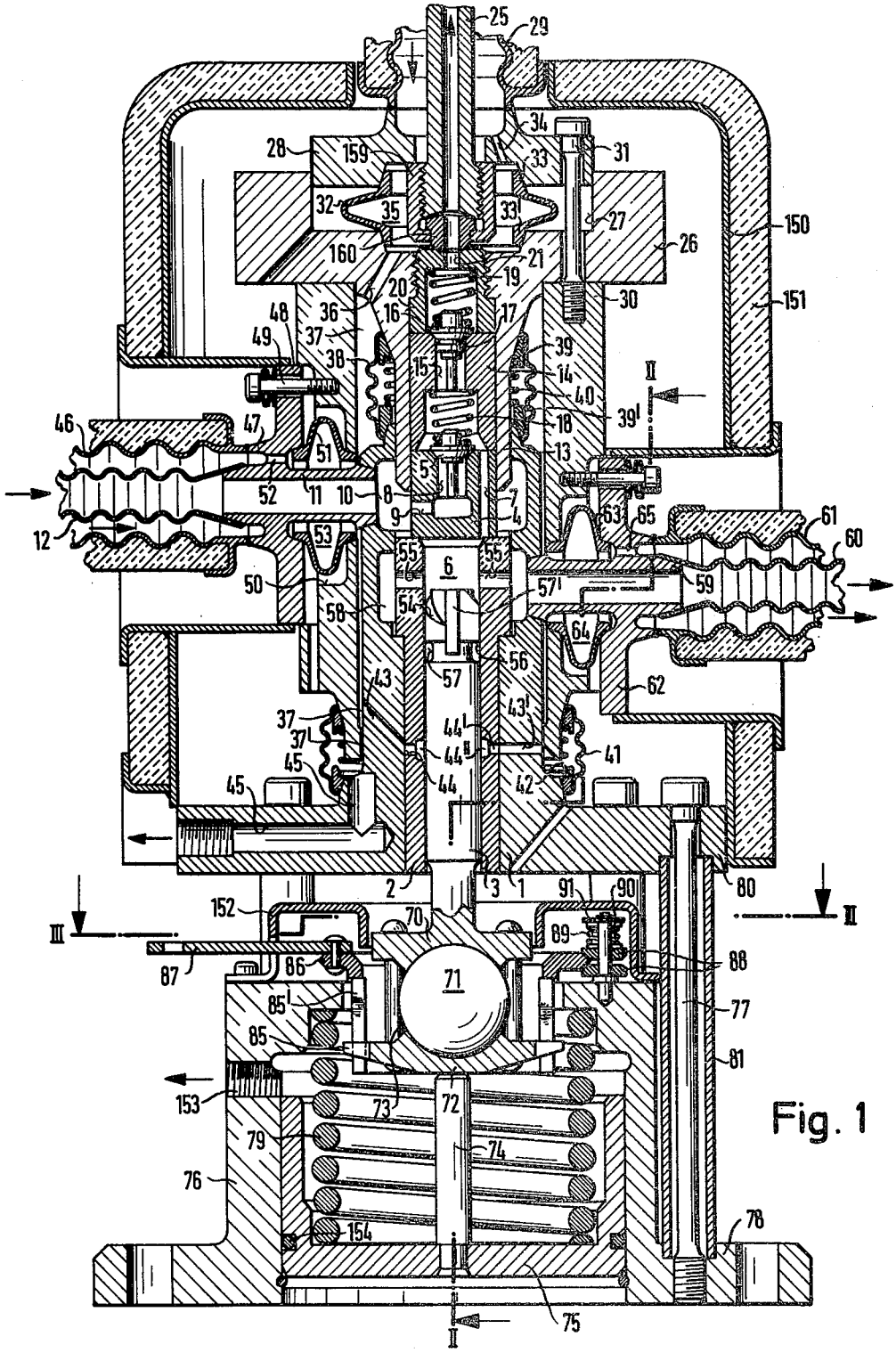
FIG. 1 illustrates an axial cross-sectional view through an injection pump according to the invention taken on line I—I of FIG. 3.

Referring to FIG. 1, the injection pump includes a housing 1 in which a cylinder 2 is secured for slidably guiding a piston 3. In addition, a suction valve is mounted within the housing 1 and includes a valve body 4 above the cylinder 2 and a suitable axially movable closing member 5 for seating on the valve body 4. As shown, the valve body 4 closes off one end of a chamber 6 formed within the cylinder 2 above the upper end of the piston 3 while an axial bore 7 is laterally disposed in the suction valve body 4 to communicate the chamber 6 to the upper surface of the valve body 4. The valve body 4 also has an internal bore 8 which communicates via a radial passage 9 with an annular chamber 10 in the housing 1 which surrounds the valve body 4. This annular chamber 10 is, in turn, connected via a nipple 11 with a suction line 12 which serves to deliver a liquified fuel to the pump. The suction line 12 is constructed as a corrugated pipe or tube and is tightly welded to the nipple 11.

The upper end of the pump housing 1 houses a nipple 13 which envelops the upper end of the valve body 4 and mounts a pressure valve body 14 therein. This pressure valve body 14 forms a central bore 15 which is closed off via a closing member 16 which has a shoulder 17 extending into the bore 15. As shown, a compression spring 18 is disposed in the pressure valve body 14 to bias the closing member 5 against the valve body 4 while a similar compression spring 19 is disposed within a cup-shaped insert 20 in the nipple 13 to bias the closing member 16 against the pressure valve body 14. This insert 20 also has a central passage 21 through which fuel may flow out of the pump to a pressure line 25.

As shown, the nipple 13 has a flange 26 at the upper end which is provided with a recess 27 which receives a flanged collar 28. This collar 28 is secured in place via bolts 31 which pass through the collar 28 and flange 26 into threaded engagement with a cylindrical jacket 30 about the pump 1. The end of the pressure line 25 facing the cup-shaped insert 20 is provided with a screw cap 159 which holds a sealing nipple 160 against the end face of the pressure line 25. The sealing nipple 160 is pressed against the cup-shaped insert 20 by the flange 28 which is braced against the screw cap 159 via the bolts 31.

A means for heating the pump, the suction line 12 and the pressure line 25 includes, in addition to the jacket 30, a plurality of jackets which surround the suction line and pressure line to define spaces for a flow of heating medium from a suitable source (not shown). As shown, the fuel feed line 12 is surrounded over the entire length by a jacket 46 which is constructed in the manner of a corrugated pipe and is welded to a ring-shaped extension 47 of a flange 48 of the nipple 11. The flange 48 is, in turn, fastened to the jacket 30 via screw bolts 49. In addition, a metallic bellows-like annular sealing body 51 is disposed between the flange 48 and a recess 50 in the jacket 30. The space 53 enclosed by the bellows-like sealing body 51 is connected via a bore 52 in the flange 48 to the space between the suction line 12 and the jacket 46, in which a heating medium flows to the injection pump.

In a similar fashion, a jacket 29 in the form of a corrugated pipe surrounds the pressure line 25 and is welded to a ring-shaped extension of the flange 28. Also, a bellows-like sealing body 32 is secured between the flanges 26, 28. This sealing body 32, in similar manner to the sealing body 51, has an outward curved fold and a pair of rings 33, 33' at opposite sides of the fold. Each ring 33, 33' has an outer conical sealing surface secured to corresponding surfaces on each respective flange 26, 28. As indicated, the sealing body 31 is pre-tensioned by the bolts 31.

The space 35 enclosed by the bellows-like sealing body 32 is connected on one side via a bore 34 to the space between the pressure line 25 and the corrugated jacket 29 and on the other side via a bore 36 in the nipple 13 with the space 37 which is formed between the shell 30, the nipple 13 and the housing 1. A heating medium flows in the space between the pressure line 25 and the jacket 29 at a temperature which is sufficiently high so that the temperature of the liquified fuel does not drop appreciably during travel to the injection nozzle. The heating medium flows via the bore 34, the space 35 and the bore 36 into the space 37.

In order to prevent heating medium from penetrating into the stream of fuel, a corrugated tubular seal 38 is provided between the upper end of the housing 1 and the nipple 13. This seal 38 has a pair of rings 39, 39'; at opposite ends, each of which has an internal conical sealing surface engaging a conical surface on the housing 1 and nipple 13. A compression spring 40 is provided between the rings 39, 39' in order to ensure continuous contact of the rings with the associated sealing surfaces.

An identically structured seal in the form of a corrugated tube 41 is provided at the lower end (FIG. 1) of the jacket 30, the sealing surfaces of which interact with correspondingly conical surfaces on the jacket 30 and the housing 1. This seal 44 seals off an annular space 42 in which the heating medium collects after flowing through the space 37 via a number of slots 37' (FIG. 4) uniformly distributed over the circumference of the jacket 30. This medium can serve as a flushing medium for the pump piston 3. For this purpose, the lower end (FIG. 1) of the space 37 communicates via a bore 43 in the housing 1 and a passage 44 in the cylinder 2 with an annular space 44'' about the piston 3. The annular space 44'' also communicates via a bore 44' in the cylinder 2 and a bore 43' in the housing 1 with the space 42 within the seal 41. An angled outlet 45 which is arranged in the housing 1 is connected to the space 42 to discharge the flushing medium from the pump and is connected to a separator (not shown) in which fuel residue which may be present and is taken along by the flushing medium, is separated from the flushing medium.

As shown in FIG. 1, the space 53 defined by the sealing body 51 is in communication with the space 37 about the housing 1 so that two streams of heating media cross in the vicinity of the suction valve of the pump and become mixed in the process.

Referring to FIG. 1, the upper end of the piston 3 is provided with control edges 54 which together with radial bores 55 in the cylinder 2, control the start of the injection. The piston 3 is formed with a circular groove 57 to define a control edge which, together with longitudinal slots 57' arranged in the piston 3 and the radial bores 55, controls the end of the injection. An annular chamber 58 is also formed in the housing 1 in the vicinity of the radial bores 55 to which a nipple 59 is connected; which nipple 59 has the same shape and arrangement as the nipple 11. A fuel discharge or overflow line 60 in the form of a corrugated pipe is connected to the nipple 59 and, as the suction line 12 is surrounded by a jacket 61 in the form of a corrugated pipe, likewise welded to the nipple 59. A bellows-like sealing body 63 is also located between the flange 62 of the nipple 59 and the jacket 30 to enclose a space 64 which is connected on one side with the space 37 and, on the other side, via a bore 65, with the space between the fuel discharge line 60 and the jacket 61. Thus, the overflowing fuel which is pumped in excess by the injection pump and thus does not pass to the fuel nozzle via the fuel line 25, is also protected against a drop in temperature in the overflow line 60.

Figure 2:
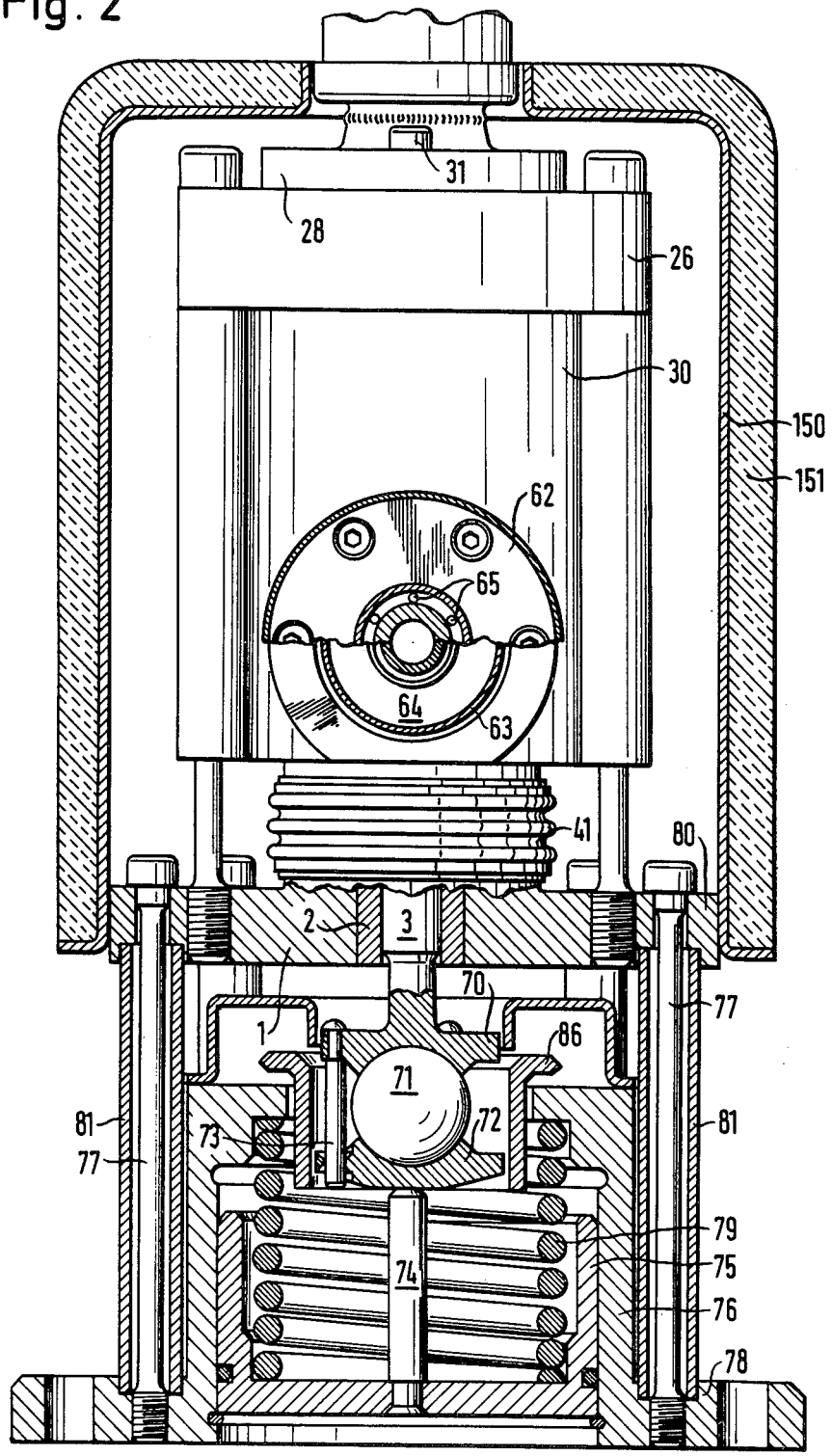
FIG. 2 illustrates a view taken on line II—II of FIG. 1.

As shown in FIGS. 1 and 2, the lower end of the piston 3 is in the form of a flange 70 which has a spherical recess at the underside and against which a sphere 71 of suitable size rests. The sphere 71 consists of a material with low thermal conductivity, e.g. ceramics. A driving means is disposed outside the housing 1 for imparting motion to the piston 3. This driving means includes a ball cup 72 on the lower side of the sphere 71 which is pushed against the ball 71 by means of a pin 74. The pin 74 is secured in a cup-shaped part 75 of the driving means which rests on a driving cam (not shown) in a manner known per se for driving the pump. The cup-shaped part 75 slides in a cylindrical support 76 to which the housing 1 of the injection pump is fastened by means of posts which are composed of bolts 77 and spacer sleeves 81 between a flange 78 of the support 76 and a flange 80 of the housing 1. A compression spring 79 is disposed between the cylindrical support 76 and the cup-shaped part 75 to ensure continuous contact of the part 75 with the above-mentioned driving cam.

The flange 70 and the ball cup 72 are secured against rotation and are connected with each other via three driving pins 73 which are uniformly distributed over the circumference of the flange 70 (FIG. 3). According to FIG. 2, the holes in the ball cup 72 which receive the driving pins 73 are expanded conically on both sides, so that the wall of each hole surrounds the associated pin 74 in the manner of a knife edge and a certain amount of pivoting of the pin 74 and, thus, tilting of the ball cup 72 relative to the flange 70 is possible. The ball cup 72 as shown in FIG. 1 has two radial extensions 85 which interconnect with two slots 85' in a sleeve 86 which has a radially outward-extending setting lever 87. The sleeve 86 is supported without play on the cylindrical support 76 and has a conical periphery which is rotatably supported in a plurality of upstanding guides, e.g. three, distributed on the support 76. Each of these upstanding guides has a pair of washers 88 mounted on a post 90 to engage the conical periphery of the sleeve 86. The washers 88 are biased together by a spring 89 which abuts a stop 91 on the upper end of the post 90. The lever 87 is disposed to turn about a pivot axis coincident with the axis of the piston 3 for rotation of the ball cup 72 and piston 3. This allows the piston 3 to be rotated in order to adjust the amount of fuel injected by changing the position of the control edges 54 relative to the bores 55.

Referring to FIG. 1, a sheet metal housing 150 extends over the entire injection pump from the flange 80 of the housing 1. This sheet metal housing 150 is covered on the outside with a heat insulating layer 151. The jackets 29, 46 and 61 of the three lines connected to the pump are likewise covered with a heat insulating layer. These heat insulating layers reduce the heat loss to the environment.

In addition, a radiation protection baffle 152 is positioned between the driving means and pump housing 1 to shield the driving means against heat radiation emanating from the pump.

Through the arrangement of the ball 71 between the pump piston 3 and the driving means, an effective separation of the pump, which is hot due to the heating, from the driving means, which remains relatively cold, is achieved. Thus, trouble at the pump is impossible due to heating of the driving means over extended periods of operation.

Also, due to the "stilted" structure described, consisting of the bolts 77 and the spacer sleeves 81, separation of the hot injection pump from the driving means is aided as natural ventilation occurs between the flange 80 of the pump housing and the radiation protection baffle 152.

The heating medium which flows along the piston 3 and escapes from the cylinder 2 at the bottom drips through a collecting opening formed by a central depression of the radiation protection baffle 152 between the housing 1 and support 76 and from there, past the flange 70 and the ball cup 72 into the cup-shaped part 75. If the cup-shaped part 75 is filled, the leakage fluid flows over into the annular space above the part 75 and returns from there via a port 153 into a collecting receptacle (not shown). So that no leakage fluid can get onto the cam drive, an O-ring 154 is provided in the cup-shaped part 75 as a seal.

Figure 5:
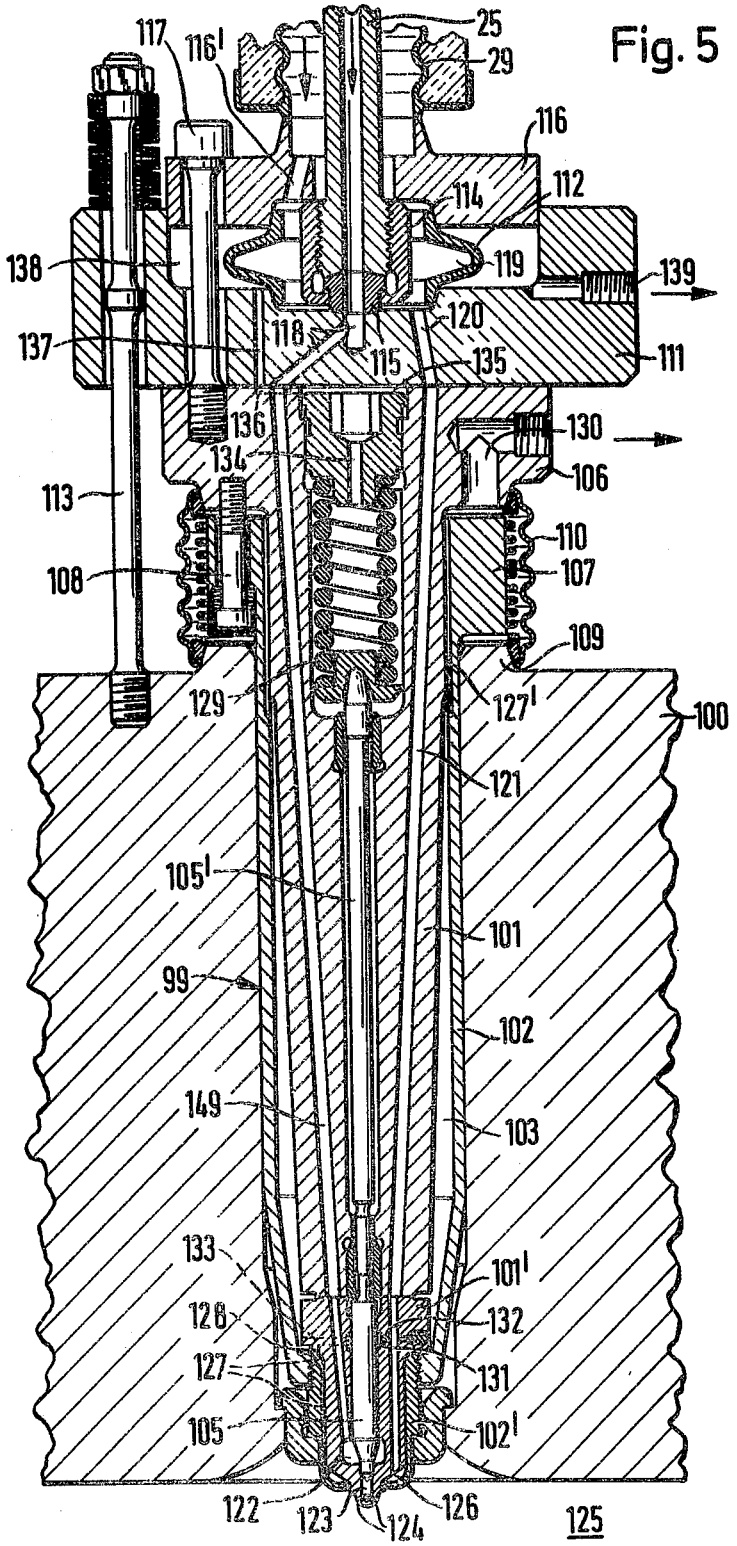
FIG. 5 illustrates an axial cross-sectional view of an injection nozzle according to the invention.

Referring to FIG. 5, the injection nozzle 99 is arranged in a cylinder head 100 which is fastened in a manner known per se on a cylinder of an internal combustion engine. The nozzle 99 consists essentially of a two-piece nozzle body 101 and 101' which is surrounded by a two-piece jacket 102 and 102' of the heating means. In addition, an annular chamber 103 extends in the axial direction between the nozzle body and the jacket for a flow of heating medium. At the upper end, the nozzle body 101 and the jacket 102 each have a flange 106 and 107, respectively, which are connected to each other by screw bolts 108. A seal 110 in the form of a corrugated tube is disposed between the flange 106 and a circular bead 109 protruding upward of the cylinder head 100. The seal 110 has a construction like the corrugated-tube seals 38 and 41 in FIG. 1. An intermediate flange 111 is supported on the upper side of the flange 106 via which the injection nozzle 99 is fastened in the cylinder head 100, specifically by means of studs 113. The pressure line 25 for the liquified fuel coming from the injection pump is connected at the center of the intermediate flange 111. For this purpose, the end of the pressure line 25 is equipped with a screw cap 114, which holds a sealing nipple 115 against the end face of the line 25. The sealing nipple 115 is pressed by a flange 116 braced against the screw cap 114 toward the intermediate flange 111 via threaded bolts 117 which pass through the flange 116 and the intermediate flange 111 into threaded engagement with the flange 106. The jacket 29 is secured to the flange 116 as above and a bellows-like sealing body 112 is provided between the flange 116 and the intermediate flange 111 in the same manner as the bellows-like sealing body 32 at the other end of the pressure line 25.

A passage 118 extends from the sealing nipple 115 in the intermediate flange 111 and communicates with a fuel line 149 in the nozzle body 101, 101'. The space 119 enclosed by the bellows-like sealing body 112 is followed in the intermediate flange 111 by a heating medium passage 120 which is continued in the nozzle body 101, 101' as a line 121. The lower end of the fuel line 149 opens into an annular space 122 which communicates with a central bore 123 which can be closed off by an axially movable nozzle needle 105 arranged in the center of the nozzle body 101'. Several ports 124 which open obliquely downward into the combustion chamber 125 and through which the liquified fuel is sprayed into the combustion chamber in jet fashion, extend from the bore 123.

The nozzle needle 105 is pushed against a conical seating surface at the transition from the annular space 122 to the bore 123 by a compression spring 129 which engages an intermediate member 105' connected with the needle.

The heating medium line 121 in the nozzle body 101 and 101' ends in an annular space 126 which starts at the height of the lower end of the nozzle needle 105 and extends between the nozzle body 101' and the jacket 102' up to the height of slots 127 which are located in the upper end of the jacket 102'. The slots 127 are uniformly distributed over the circumference of the jacket 102' (similarly to the slots 37' in the enclosure 30 of the injection pump in FIG. 4) so that the heating medium flows uniformly upward through the annular space 126. The heating medium is conducted on via angled bores 128 which are arranged in the nozzle body 101' and which establish the connection of the slots 127 with the annular chamber 103. The upper end of the chamber 103 merges into a section which is characterized by axial slots 127' formed between the nozzle body 101 and the jacket 102, and which are uniformly distributed over the circumference like the slots 127. An angled outlet 130 in the flange 106 is connected to this section to exhaust the heating medium which is conducted upward from the annular space 126 and the slots 127 and flows through the chamber 103 and the slots 127' from the injection nozzle. The heating medium issuing from the angled outlet 130 is fed to a separator (not shown) like the heating medium which acts as a flushing medium in the outlet 45 of the injection pump.

An annular space 131 surrounds the needle 105 and is connected by means of a choke bore 132 to the heating medium line 121 to serve as a flushing line for the liquified fuel which escapes from the space 122 along the nozzle needle 105. The flushing medium flowing through the space 131 leaves via a bore 133 which opens via one of the right-angle bores 128 into the chamber 103. Heating medium which escapes upward along the nozzle needle 105 past the intermediate piece 105' and the spring 129 arrives in a space 135 via a bore 134. From there, the heating medium passes via a relief slot 136 in the upper end face of the flange 106 and a bore 137 in the intermediate flange 111 into an annular space 138 which is located between the intermediate flange 111 and the flange 116 of the jacket 129. The leakage fluid leaves the space 138 and thus, the injection nozzle 99, via an outlet 139 to which a line (not shown) leads to the already mentioned collecting tank.

In the embodiment example described, the supply of the heating medium is connected to the jacket 46 near the end of the suction line 12 which is directed toward the source of the liquified fuel and to the jacket 29 at approximately mid-length of the pressure line 25 between the injection pump and the injection nozzle. Thus, a first partial stream of the heating medium flows through the jacket 46 in the same direction as the liquified fuel in the suction line 12. The other partial stream fed to the jacket 29 is divided into two streams, one of which in a direction opposite to that of the fuel flow in the pressure line 25, flows toward the injection pump, while the other stream flows in the same direction as the fuel stream in the pressure line 25 toward the injection nozzle 99. The last-mentioned heating medium stream thus passes into the line 121 of the nozzle body 101 and 101' via a bore 116' in the flange 116, the space 119 of the bellows-like sealing body 112 and the passage 120 in the intermediate flange 111. The flow direction is reversed in the annular space 126 and the heating medium passes to the angled outlet 130 via the slots 127, the angled bores 128 and the chamber 103 as well as the slots 127'. The amount of heating medium flowing through the nozzle body 101 and 101' is chosen so that the temperature difference between the heating medium in the line 121 and the heating medium in the chamber 103 is very small.

What is claimed is:

1. In combination, a cylinder head of an internal combustion engine;

an injection nozzle mounted in said cylinder head;

an injection pump having a housing, a suction valve within said housing and a fuel overflow line;

a suction line connected to said housing in communication with said suction valve to deliver liquified fuel thereto;

a pressure line connected between said housing and said injection nozzle to deliver pressurized liquified fuel from said pump to said nozzle; and means for heating said injection nozzle, said injection pump, said overflow line, said suction line and said pressure line to maintain the fuel therein in a liquified state, said means including a plurality of jackets, each said jacket concentrically surrounding a respective one of said suction line, pressure line and overflow line;

a fourth jacket surrounding said injection pump housing and a fifth jacket surrounding said injection nozzle, and wherein said plurality of jackets are interconnected with said fourth and fifth jackets to convey a heating medium therebetween.

2. The combination as set forth in claim 1 wherein said means includes a heating medium supply connected to said jacket surrounding said suction line and connected to said jacket surrounding said pressure line at a point mid-length of said pressure line whereby two flows of heating medium are directed into said third jacket about said injection pump housing.

3. The combination as set forth in claim 1 which further comprises a separator connected to said outlet to separate fuel from the heating medium.

4. In combination, a cylinder head of an internal combustion engine;

an injection nozzle mounted in said cylinder head;

an injection pump having a housing, a suction valve within said housing, and a fuel overflow line;

a suction line connected to said housing in communication with said suction valve to deliver liquified fuel thereto;

a pressure line connected between said housing and said injection nozzle to deliver pressurized liquified fuel from said pump to said nozzle;

a cylinder;

a piston slidably mounted in said cylinder to pump the fuel from said suction line into said pressure line;

means for heating said injection nozzle, said injection pump, said overflow line, said suction line and said pressure line to maintain the fuel therein in a liquified state, said means including a plurality of jackets, each said jacket concentrically surrounding a respective one of said suction line, pressure line and overflow line, an annular space between said cylinder and said piston, a first bore in said housing and said cylinder communicating said annular space with the interior of said jacket surrounding said housing, and a second bore in said housing and said cylinder communicating said annular space to an outlet in said housing.

5. The combination as set forth in claim 4 which further comprises a separator connected to said outlet to separate fuel from the heating medium.

6. In combination, a cylinder head of an internal combustion engine;

an injection nozzle mounted in said cylinder head;

an injection pump having a housing, a suction valve within said housing and a fuel overflow line;

a suction line connected to said housing in communication with said suction valve to deliver liquified fuel thereto;

a pressure line connected between said housing and said injection nozzle to deliver pressurized liquified fuel from said pump to said nozzle; and means for heating said injection nozzle, said injection pump, said overflow line, said suction line and said pressure line to maintain the fuel therein in a liquified state;

said means including a plurality of jackets, each said jacket concentrically surrounding a respective one of said suction line, pressure line and overflow line, and wherein each of said suction line, overflow line and said jackets surrounding said suction line and overflow line are corrugated pipes.

7. The combination as set forth in claim 6 wherein said jacket surrounding said pressure line is a corrugated pipe.

8. The combination as set forth in claim 7 which further includes a plurality of metallic bellows-like annular sealing bodies, each said body being secured on one end to said jacket surrounding said housing and on the opposite end to a respective one of said corrugated pipes.

9. The combination as set forth in claim 8 wherein each sealing body has an outward curved fold and a pair of rings on opposite sides of said fold, each ring having an outer conical sealing surface, and which further includes a flange secured to a respective conical sealing surface and a respective one of said corrugated pipes.

10. In combination, a cylinder head of an internal combustion engine;

an injection nozzle mounted in said cylinder head;

an injection pump having a housing, a suction valve within said housing and a fuel overflow line;

a suction line connected to said housing in communication with said suction valve to deliver liquified fuel thereto;

a pressure line connected between said housing and said injection nozzle to deliver pressurized liquified fuel from said pump to said nozzle; and means for heating said injection nozzle, said injection pump, said overflow line, said suction line and said pressure line to maintain the fuel therein in a liquified state;

said means including a plurality of jackets, each said jacket concentrically surrounding a respective one of said suction line, pressure line and overflow line, with said jacket surrounding said pressure line being a corrugated pipe.

11. In combination, a cylinder head of an internal combustion engine;

an injection nozzle mounted in said cylinder head;

an injection pump having a housing, a suction valve within said housing and a fuel overflow line;

a suction line connected to said housing in communication with said suction valve to deliver liquified fuel thereto;

a pressure line connected between said housing and said injection nozzle to deliver pressurized liquified fuel from said pump to said nozzle;

means for heating said injection nozzle, said injection pump, said overflow line, said suction line and said pressure line to maintain the fuel therein in a liquified state;

said means including a plurality of jackets, each said jacket concentrically surrounding a respective one of said suction line, pressure line and overflow line; and metallic elastic corrugated tubular seals between said housing and said jacket surrounding said housing, each seal having a pair of rings at opposite ends, each ring having an internal conical sealing surface engaging a respective conical surface on said housing and said jacket surrounding said housing.

12. The combination as set forth in claim 11 which further includes a compression spring within each seal between said housing and said jacket surrounding said housing.

13. In combination, a cylinder head of an internal combustion engine;

an injection nozzle mounted in said cylinder head;

a metallic elastic corrugated tubular seal between said injection nozzle and said cylinder head, said seal having a pair of rings at opposite ends, each ring having an internal conical sealing surface engaging a respective conical surface on said injection nozzle and said cylinder head;

an injection pump having a housing, a suction valve within said housing and a fuel overflow line;

a suction line connected to said housing in communication with said suction valve to deliver liquified fuel thereto;

a pressure line connected between said housing and said injection nozzle to deliver pressurized liquified fuel from said pump to said nozzle; and means for heating said injection nozzle, said injection pump, said overflow line, said suction line and said pressure line to maintain the fuel therein in a liquified state;

said means including a plurality of jackets, each said jacket concentrically surrounding a respective one of said section line, pressure line and overflow line.

14. The combination as set forth in claim 13 which further includes a compression spring within said seal between said nozzle and said cylinder head.

15. In combination, a cylinder head of an internal combustion engine;

an injection nozzle mounted in said cylinder head;

an injection pump having a housing, a suction valve within said housing, a reciprocating piston, a driving means for said piston outside said housing, and a ceramic sphere of low thermal conductivity between said piston and said driving means for imparting motion from said driving means to said piston;

a suction line connected to said housing in communication with said suction valve to deliver liquified fuel thereto;

a pressure line connected between said housing and said injection nozzle to deliver pressurized liquified fuel from a said pump to said nozzle; and means for heating said injection nozzle, said injection pump, said suction line and said pressure line to maintain the fuel therein in a liquified state.

16. The combination as set forth in claim 15 which further includes a flange on said piston receiving said sphere, a ball cup opposite said flange and receiving said sphere, drive pins connecting said ball cup to said flange to transmit a rotary motion to said piston and means biasing said ball cup away from said drive means.

17. The combination as set forth in claim 16 wherein each drive pin is fixedly secured to said flange and pivotally mounted in said ball cup.

18. The combination as set forth in claim 17 which further includes a sleeve surrounding said sphere and interconnected to said ball cup and a lever secured to and extending from said sleeve about a pivot axis coincident with the axis of said piston for rotating said ball cup and piston.

19. The combination as set forth in claim 18 wherein said sleeve has a conical periphery and which further includes a support and a plurality of guides mounted on said support for rotatably supporting said periphery of said sleeve therein, each said guide including a pair of spring biased washers engaging said periphery therebetween.

20. The combination as set forth in claim 19 which further includes a radiation baffle between said housing and said support, said baffle having an opening for said piston.

21. In combination, a cylinder head of an internal combustion engine;

an injection nozzle mounted in said cylinder head;

an injection pump having a housing and a suction valve within said housing;

a suction line connected to said housing in communication with said suction valve to deliver liquified fuel thereto;

a pressure line connected between said housing and said injection nozzle to deliver pressurized liquified fuel from said pump to said nozzle;

a support;

a plurality of posts mounting said housing on said support in spaced relation; and means for heating said injection nozzle, said injection pump, said suction line and said pressure line to maintain the fuel therein in a liquified state.

22. The combination as set forth in claim 21 wherein each post includes a spacer sleeve and a bolt within said spacer sleeve and secured to said support and said housing.

* * * * *

UNITED STATES PATENT AND TRADEMARK OFFICE

CERTIFICATE OF CORRECTION

PATENT NO. : 4,148,288

DATED : April 10, 1979

INVENTOR(S) : ANTON STEIGER

It is certified that error appears in the above-identified patent and that said Letters Patent are hereby corrected as shown below:

Column 3, line 49, after "medium" insert --thus--

Column 10, line 17, change "section" to --suction--

Signed and Sealed this

*Eleventh* Day of *September 1979*

[SEAL]

*Attest:*

*Attesting Officer*

LUTRELLE F. PARKER

*Acting Commissioner of Patents and Trademarks*